US011176889B2

(12) United States Patent
Kim et al.

(10) Patent No.: US 11,176,889 B2
(45) Date of Patent: Nov. 16, 2021

(54) DISPLAY APPARATUS AND METHOD OF DRIVING THE SAME

(71) Applicant: Samsung Display Co., Ltd., Yongin-si (KR)

(72) Inventors: Wontae Kim, Hwaseong-si (KR); Bong-Hyun You, Seoul (KR); Sun-Koo Kang, Seoul (KR); Joon Chul Goh, Suwon-si (KR); Soon-Dong Kim, Osan-si (KR); Jin-Wook Yang, Suwon-si (KR); Ki Hong Song, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/927,729

(22) Filed: Jul. 13, 2020

(65) Prior Publication Data

US 2021/0074216 A1 Mar. 11, 2021

(30) Foreign Application Priority Data

Sep. 9, 2019 (KR) ..... 10-2019-0111699

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2300/0842* (2013.01); *G09G 2310/0291* (2013.01); *G09G 2320/02* (2013.01); *G09G 2330/02* (2013.01)

(58) Field of Classification Search
None
See application file for complete search history.

(56) References Cited

U.S. PATENT DOCUMENTS

2017/0039955 A1* 2/2017 Park ..... G09G 3/3233
2017/0154578 A1* 6/2017 In ..... G09G 3/3283

FOREIGN PATENT DOCUMENTS

KR 10-0334864 B1 8/2002
KR 10-1277937 B1 6/2013
KR 10-2014-0137859 A 12/2014
KR 10-2016-0070194 A 6/2016

* cited by examiner

*Primary Examiner* — Christopher J Kohlman
(74) *Attorney, Agent, or Firm* — Lewis Roca Rothgerber Christie LLP

(57) ABSTRACT

A display apparatus includes a display panel, a data driver, and a power voltage generator. The display panel includes a plurality of pixels and configured to display an image. The data driver is configured to apply a data voltage to the display panel. The power voltage generator is configured to provide a power voltage and an initialization voltage to the display panel. The power voltage generator is configured to receive a feedback initialization voltage from the display panel and configured to compensate the initialization voltage based on the feedback initialization voltage.

20 Claims, 13 Drawing Sheets

DISPLAY APPARATUS AND METHOD OF DRIVING THE SAME

CROSS-REFERENCE TO RELATED APPLICATION

This application claims priority to and the benefit of Korean Patent Application No. 10-2019-0111699, filed on Sep. 9, 2019 in the Korean Intellectual Property Office KIPO, the entire content of which is herein incorporated by reference in its entirety.

FIELD

Example embodiments of the present disclosure relate to a display apparatus and a method of driving the display apparatus. More particularly, example embodiments of the present disclosure relate to a display apparatus for receiving a feedback voltage of an initialization voltage of a pixel and for compensating the initialization voltage and a method of driving the display apparatus.

BACKGROUND

A display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver. In addition, the display panel driver may further include a power voltage generator for applying a power voltage and an initialization voltage to the display panel.

When a level of the initialization voltage applied to the pixel is unstable, an image displayed on the display panel may be unstable. Thus, the display quality of the display panel may be deteriorated.

The above information disclosed in this Background section is only for enhancement of understanding of the background of the invention and therefore it may contain information that does not constitute prior art.

SUMMARY

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

Aspects of example embodiments of the present disclosure are directed toward a display apparatus for receiving a feedback voltage of an initialization voltage of a pixel and for compensating the initialization voltage to enhance a display quality of a display panel.

Aspects of example embodiments of the present disclosure are directed toward a method of driving the display apparatus.

In an example embodiment of a display apparatus according to the present disclosure, the display apparatus includes a display panel, a data driver and a power voltage generator. The display panel includes a plurality of pixels and configured to display an image. The data driver is configured to apply a data voltage to the display panel. The power voltage generator is configured to provide a power voltage and an initialization voltage to the display panel. The power voltage generator is configured to receive a feedback initialization voltage from the display panel and configured to compensate the initialization voltage based on the feedback initialization voltage.

In an example embodiment, at least one of the pixels may include an organic light emitting element. At least one of the pixels may be configured to receive a data write gate signal, a data initialization gate signal, the data voltage, and the initialization voltage, and the at least one of the pixels is configured to emit light via the organic light emitting element according to a level of the data voltage to display the image.

In an example embodiment, when a data write gate signal of a first pixel among the pixels is activated, a data initialization gate signal of a second pixel among the pixels may be activated.

In an example embodiment, at least one of the pixels may include a first pixel switching element (including a control electrode connected to a first node, an input electrode connected to a second node, and an output electrode connected to a third node), a second pixel switching element (including a control electrode to which the data write gate signal is applied, an input electrode to which the data voltage is applied, and an output electrode connected to the second node), a third pixel switching element (including a control electrode to which the data write gate signal is applied, an input electrode connected to the first node, and an output electrode connected to the third node), a fourth pixel switching element (including a control electrode to which the data initialization gate signal is applied, an input electrode to which the initialization voltage is applied, and an output electrode connected to the first node), a fifth pixel switching element (including a control electrode to which the emission signal is applied, an input electrode to which a high power voltage is applied, and an output electrode connected to the second node), a sixth pixel switching element (including a control electrode to which the emission signal is applied, an input electrode connected to the third node, and an output electrode connected to an anode electrode of the organic light emitting element), a seventh pixel switching element (including a control electrode to which the data initialization gate signal is applied, an input electrode to which the initialization voltage is applied, and an output electrode connected to the anode electrode of the organic light emitting element), a storage capacitor (including a first electrode to which the high power voltage is applied and a second electrode connected to the first node), and the organic light emitting element (including the anode electrode and a cathode electrode to which a low power voltage is applied).

In an example embodiment, the power voltage generator may include an amplifier (including a first input terminal, a second input terminal, and an output terminal), an input resistor (including a first end portion configured to receive the feedback initialization voltage and a second end portion connected to the first input terminal), and an output resistor connected between the first input terminal and the output terminal. A reference voltage may be applied to the second input terminal. The output terminal may be configured to output the initialization voltage.

In an example embodiment, the power voltage generator may be configured to adjust a gain representing a ratio of the initialization voltage and the feedback initialization voltage.

In an example embodiment, the power voltage generator may include an amplifier including a first input terminal, a second input terminal, and an output terminal, an input resistor including a first end portion configured to receive the feedback initialization voltage and a second end portion connected to the first input terminal, a plurality of switches connected to the first input terminal and a plurality of output resistors connected between the switches and the output terminal. A reference voltage may be applied to the second input terminal. The output terminal may be configured to output the initialization voltage.

In an example embodiment, the power voltage generator may be configured to receive a first feedback initialization voltage from a first position of the display panel and a second feedback initialization voltage from a second position of the display panel.

In an example embodiment, the power voltage generator may include an amplifier (including a first input terminal, a second input terminal, and an output terminal), a first input switch configured to receive the first feedback initialization voltage, a second input switch configured to receive the second feedback initialization voltage, an input resistor (including a first end portion connected to the first input switch and the second input switch and a second end portion connected to the first input terminal), a plurality of switches connected to the first input terminal, and a plurality of output resistors connected between the switches and the output terminal. A reference voltage may be applied to the second input terminal. The output terminal may be configured to output the initialization voltage.

In an example embodiment, when a second distance from the second position of the display panel to the power voltage generator is greater than a first distance from the first position of the display panel to the power voltage generator, a second gain representing a ratio of the initialization voltage and the second feedback initialization voltage may be greater than a first gain representing a ratio of the initialization voltage and the first feedback initialization voltage.

In an example embodiment, wherein the power voltage generator may be configured to adjust a slew rate of the initialization voltage.

In an example embodiment, the power voltage generator may include an amplifier (including a first input terminal, a second input terminal, and an output terminal), an input resistor (including a first end portion configured to receive the feedback initialization voltage and a second end portion connected to the first input terminal), an output resistor connected between the first input terminal and the output terminal, a slew rate adjusting switch connected to the first input terminal and a capacitor (including a first electrode connected to the slew rate adjusting switch and a second electrode connected to the output terminal). A reference voltage may be applied to the second input terminal. The output terminal may be configured to output the initialization voltage.

In an example embodiment, the power voltage generator may be configured to adjust a gain representing a ratio of the initialization voltage and the feedback initialization voltage.

In an example embodiment, the power voltage generator may further include a plurality of switches connected to the first input terminal and a plurality of output resistors connected between the plurality of switches and the output terminal.

In an example embodiment, where the slew rate adjusting switch includes a plurality of slew rate adjusting switches and the capacitor includes a plurality of capacitors connected between the slew rate adjusting switches and the output terminal.

In an example embodiment of a method of driving a display apparatus, the method includes applying a gate signal to a plurality of pixels of a display panel, applying a data voltage to the plurality of pixels of the display panel, applying a power voltage and an initialization voltage to the plurality of pixels using a power voltage generator, receiving a feedback initialization voltage from the display panel, and compensating the initialization voltage based on the feedback initialization voltage.

In an example embodiment, the power voltage generator may include an amplifier (including a first input terminal, a second input terminal, and an output terminal), an input resistor (including a first end portion configured to receive the feedback initialization voltage and a second end portion connected to the first input terminal,) and an output resistor connected between the first input terminal and the output terminal. A reference voltage may be applied to the second input terminal. The output terminal may be configured to output the initialization voltage.

In an example embodiment, the power voltage generator may be configured to adjust a gain representing a ratio of the initialization voltage and the feedback initialization voltage.

In an example embodiment, the power voltage generator may be configured to receive a first feedback initialization voltage from a first position of the display panel and a second feedback initialization voltage from a second position of the display panel.

In an example embodiment, wherein the power voltage generator may be configured to adjust a slew rate of the initialization voltage.

According to some example embodiments, the display apparatus and the method of driving the display apparatus, the display apparatus includes the power voltage generator for receiving the feedback voltage of the initialization voltage of the pixel and for compensating the initialization voltage. Thus, a distortion of the initialization voltage may be reduced or prevented so that an output current of the pixel may not be changed due to the distortion of the initialization voltage. Accordingly, the display defect due to the change of the output current of the pixel may be reduced or prevented so that the display quality of the display panel may be enhanced.

BRIEF DESCRIPTION OF THE DRAWINGS

The above and other features of the present disclosure will become more apparent by describing in detailed example embodiments thereof with reference to the accompanying drawings, in which.

DETAILED DESCRIPTION

Figure 1:
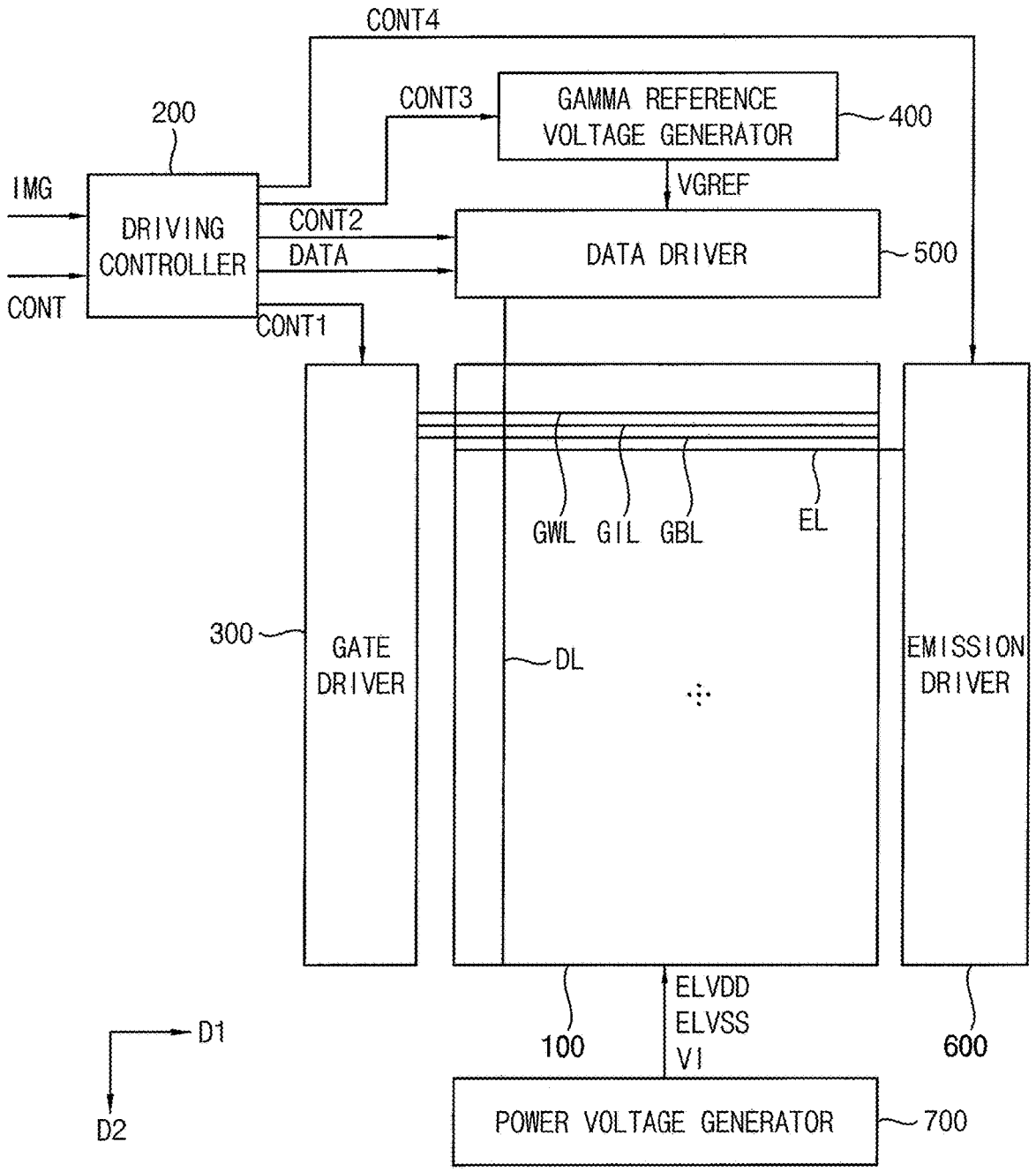
FIG. 1 is a block diagram illustrating a display apparatus, according to some example embodiments of the present disclosure.

The detailed description set forth below in connection with the appended drawings is intended as a description of some example embodiments of a display apparatus and method of driving the same provided in accordance with the present disclosure and is not intended to represent the only forms in which the example embodiments of the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures.

It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the disclosure refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a display apparatus and method of driving the same have been specifically described and illustrated herein, many modifications and variations will be apparent to those skilled in the art. Accordingly, it is to be understood that a display apparatus and method of driving the same constructed according to principles of this invention may be embodied other than as specifically described herein. The invention is also defined in the following claims, and equivalents thereof.

Hereinafter, the present disclosure will be explained in detail with reference to the accompanying drawings.

FIG. 1 is a block diagram illustrating a display apparatus, according to some example embodiments of the present disclosure.

Referring to FIG. 1, the display apparatus includes a display panel 100 and a display panel driver. The display panel driver includes a driving controller 200, a gate driver 300, a gamma reference voltage generator 400, a data driver 500 and an emission driver 600. The display panel driver further includes a power voltage generator 700.

For example, the driving controller 200 and the data driver 500 may be integrally formed. For example, the driving controller 200, the data driver 500, and the power voltage generator 700 may be integrally formed. For example, the driving controller 200, the gamma reference voltage generator 400, and the data driver 500 may be integrally formed. For example, the driving controller 200, the gate driver 300, the gamma reference voltage generator 400, and the data driver 500 may be integrally formed. For example, the driving controller 200, the gate driver 300, the gamma reference voltage generator 400, the data driver 500, and the emission driver 600 may be integrally formed. For example, the driving controller 200, the gate driver 300, the gamma reference voltage generator 400, the data driver 500, the emission driver 600, and the power voltage generator 700 may be integrally formed.

The display panel 100 includes a plurality of gate lines GWL, GIL, and GBL, a plurality of data lines DL, a plurality of emission lines EL, and a plurality of pixels (electrically connected to the gate lines GWL, GIL, and GBL, the data lines DL, and the emission lines EL). The gate lines GWL, GIL, and GBL extend in a first direction D1, the data lines DL extend in a second direction D2 crossing the first direction D1, and the emission lines EL extend in the first direction D1.

The driving controller 200 receives input image data IMG and an input control signal CONT from an external apparatus. For example, the input image data IMG may include red image data, green image data, and blue image data. The input image data IMG may also include white image data. The input image data IMG may further include magenta image data, cyan image data, and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWL, GIL, and GBL in response to the first control signal CONT1 received from the driving controller 200. The gate driver 300 may sequentially output the gate signals to the gate lines GWL, GIL, and GBL. For example, the gate driver 300 may be mounted on the display panel 100. For example, the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be located in the driving controller 200, or in the data driver 500.

The data driver 500 receives the second control signal CONT2 and the data signal DATA from the driving controller 200, and receives the gamma reference voltage VGREF from the gamma reference voltage generator 400. The data driver 500 converts the data signal DATA into data voltages having an analog type (e.g., in an analog driving process) using the gamma reference voltage VGREF. The data driver 500 outputs the data voltages to the data lines DL.

The emission driver 600 generates emission signals to drive the emission lines EL in the display panel 100 in response to the fourth control signal CONT4 received from the driving controller 200. The emission driver 600 may output the emission signals to the emission lines EL.

The power voltage generator 700 may generate a power voltage for operating the display panel 100 and the display panel driver. For example, the power voltage generator 700 may output a high power voltage ELVDD to a pixel circuit of the display panel 100. For example, the power voltage generator 700 may output a low power voltage ELVSS to the pixel circuit of the display panel 100. For example, the power voltage generator 700 may output an initialization voltage VI to the pixel circuit of the display panel 100.

Figure 2:
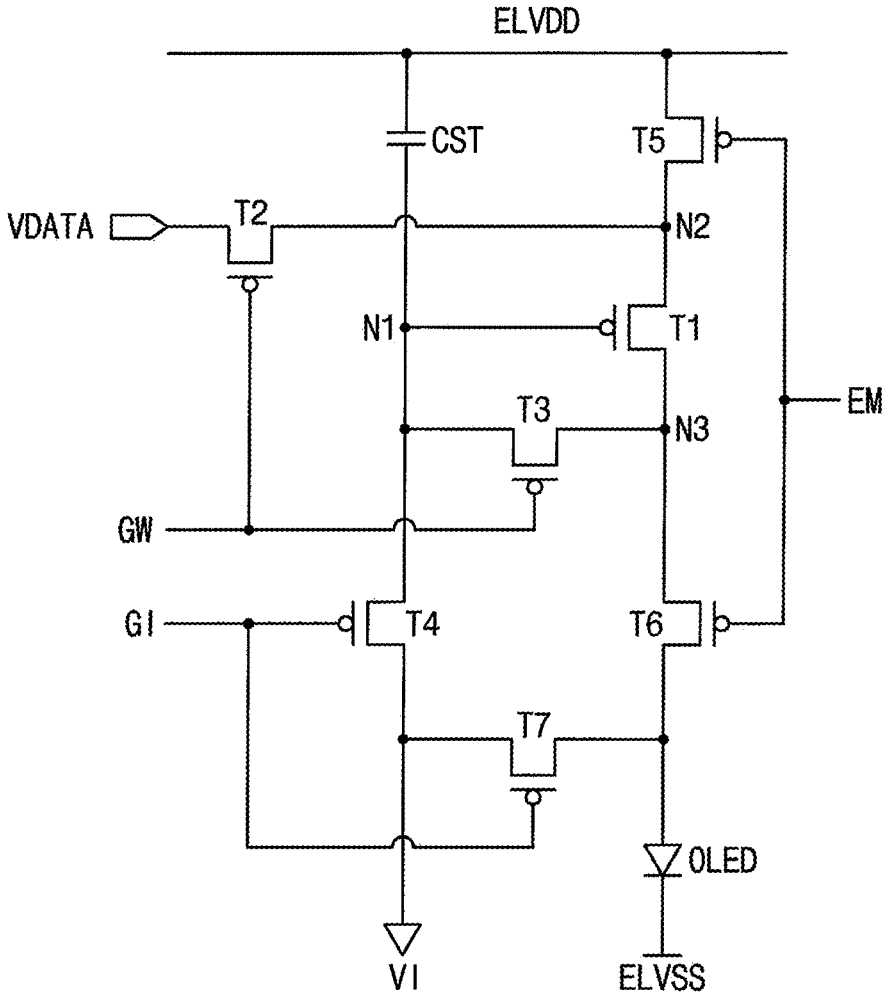
FIG. 2 is a circuit diagram illustrating a pixel of a display panel of FIG. 1, according to some example embodiments of the present disclosure.
Figure 3:
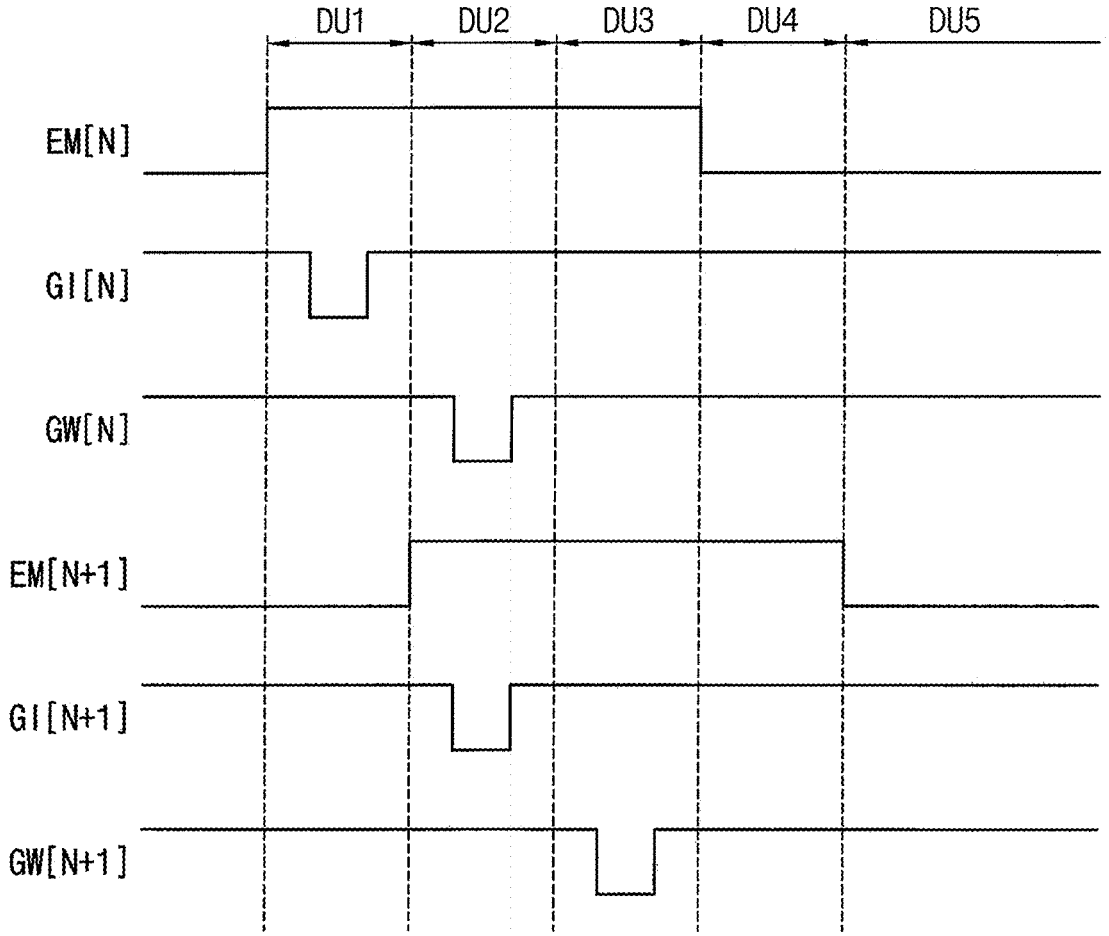
FIG. 3 is a timing diagram illustrating input signals applied to the pixel of FIG. 2, according to some example embodiments of the present disclosure.

FIG. 2 is a circuit diagram illustrating the pixel of the display panel 100 of FIG. 1, according to some example embodiments of the present disclosure. FIG. 3 is a timing diagram illustrating input signals applied to the pixel of FIG. 2, according to some example embodiments of the present disclosure.

Referring to FIGS. 1-3, the display panel 100 includes the plurality of the pixels. Each pixel includes an organic light emitting diode OLED.

The pixels receive a data write gate signal GW, a data initialization gate signal GI, an organic light emitting diode initialization signal VI, the data voltage VDATA, and the emission signal EM, and the organic light emitting diode OLED of the pixels emit light corresponding to the level of the data voltage VDATA to display the image. In some example embodiments, the organic light emitting diode initialization signal VI may be same as the data initialization gate signal GI.

At least one of the pixels may include first to seventh pixel switching elements T1 to T7, a storage capacitor CST, and the organic light emitting diode OLED.

The first pixel switching element T1 includes a control electrode connected to a first node N1, an input electrode connected to a second node N2, and an output electrode connected to a third node N3.

For example, the first pixel switching element T1 may be a P-type thin film transistor (TFT). The control electrode of the first pixel switching element T1 may be a gate electrode, the input electrode of the first pixel switching element T1 may be a source electrode, and the output electrode of the first pixel switching element T1 may be a drain electrode.

The second pixel switching element T2 includes a control electrode to which the data write gate signal GW is applied, an input electrode to which the data voltage VDATA is applied, and an output electrode connected to the second node N2.

For example, the second pixel switching element T2 may be a P-type thin film transistor (TFT). The control electrode of the second pixel switching element T2 may be a gate electrode, the input electrode of the second pixel switching element T2 may be a source electrode, and the output electrode of the second pixel switching element T2 may be a drain electrode.

The third pixel switching element T3 includes a control electrode to which the data write gate signal GW is applied, an input electrode connected to the first node N1, and an output electrode connected to the third node N3.

For example, the third pixel switching element T3 may be a P-type thin film transistor (TFT). The control electrode of the third pixel switching element T3 may be a gate electrode, the input electrode of the third pixel switching element T3 may be a source electrode, and the output electrode of the third pixel switching element T3 may be a drain electrode.

The fourth pixel switching element T4 includes a control electrode to which the data initialization gate signal GI is applied, an input electrode to which the initialization voltage VI is applied, and an output electrode connected to the first node N1.

For example, the fourth pixel switching element T4 may be a P-type thin film transistor (TFT). The control electrode of the fourth pixel switching element T4 may be a gate electrode, the input electrode of the fourth pixel switching element T4 may be a source electrode, and the output electrode of the fourth pixel switching element T4 may be a drain electrode.

The fifth pixel switching element T5 includes a control electrode to which the emission signal EM is applied, an input electrode to which a high power voltage ELVDD is applied, and an output electrode connected to the second node N2.

For example, the fifth pixel switching element T5 may be a P-type thin film transistor (TFT). The control electrode of the fifth pixel switching element T5 may be a gate electrode, the input electrode of the fifth pixel switching element T5 may be a source electrode, and the output electrode of the fifth pixel switching element T5 may be a drain electrode.

The sixth pixel switching element T6 includes a control electrode to which the emission signal EM is applied, an input electrode connected to the third node N3, and an output electrode connected to an anode electrode of the organic light emitting diode OLED.

For example, the sixth pixel switching element T6 may be a P-type thin film transistor (TFT). The control electrode of the sixth pixel switching element T6 may be a gate electrode, the input electrode of the sixth pixel switching element T6 may be a source electrode, and the output electrode of the sixth pixel switching element T6 may be a drain electrode.

The seventh pixel switching element T7 includes a control electrode to which the organic light emitting diode initialization gate signal GI is applied, an input electrode to which the initialization voltage VI is applied, and an output electrode connected to the anode electrode of the organic light emitting diode OLED.

For example, the seventh pixel switching element T7 may be a P-type thin film transistor (TFT). The control electrode of the seventh pixel switching element T7 may be a gate electrode, the input electrode of the seventh pixel switching element T7 may be a source electrode, and the output electrode of the seventh pixel switching element T7 may be a drain electrode.

The storage capacitor CST includes a first electrode to which the high power voltage ELVDD is applied and a second electrode connected to the first node N1.

The organic light emitting diode OLED includes the anode electrode and a cathode electrode to which a low power voltage ELVSS is applied.

In some embodiments, as shown in FIG. 3, in a pixel located in an N-th row of the plurality of pixel rows in the display panel 100, during a first duration DU1, the first node N1 and the storage capacitor CST are initialized in response to the data initialization gate signal GI[N]. During the first duration DU1, the anode electrode of the organic light emitting diode OLED is initialized in response to the organic light emitting diode initialization gate signal GI[N]. During a second duration DU2, a threshold voltage |VTH| of the first pixel switching element T1 is compensated, and the data voltage VDATA (of which the threshold voltage |VTH| is compensated) is written to the first node N1 in response to the data write gate signal GW[N]. During a fourth duration DU4, a fifth duration DU5, and after the fifth duration DU5, the organic light emitting diode OLED emits the light in response to the emission signal EM[N] so that the pixels in the N-th row display the image.

In some embodiments, in a pixel located in an (N+1)-th row of the plurality of pixel rows in the display panel 100, during the second duration DU2, the first node N1 and the storage capacitor CST are initialized in response to the data initialization gate signal GI[N+1]. During the second duration DU2, the anode electrode of the organic light emitting diode OLED is initialized in response to the organic light emitting diode initialization gate signal GI[N+1]. During a third duration DU3, a threshold voltage |VTH| of the first pixel switching element T1 is compensated, and the data voltage VDATA (of which the threshold voltage |VTH| is compensated) is written to the first node N1 in response to the data write gate signal GW[N+1]. During the fifth duration DU5 and after the fifth duration DU5, the organic light emitting diode OLED emits the light in response to the emission signal EM[N+1] so that the pixels in the N-th row display the image.

In some embodiments, in the pixel located in an N-th row of the plurality of pixel rows in the display panel 100, during the first duration DU1, the data initialization gate signal GI[N] may have an active level. For example, the active level of the data initialization gate signal GI[N] may be a low level. When the data initialization gate signal GI[N] has the active level, the fourth pixel switching element T4 of the pixel of the N-th row is turned on so that the initialization voltage VI may be applied to the first node N1.

During the first duration DU1, the organic light emitting diode initialization signal GI[N] may have an active level. In some example embodiments, the organic light emitting diode initialization signal GI[N] may be the same as the data initialization gate signal GI[N]. When the organic light emitting diode initialization signal GI[N] has the active level, the seventh pixel switching element T7 of the pixel of the N-th row is turned on so that the initialization voltage VI may be applied to the anode electrode of the organic light emitting diode OLED.

In some embodiments, the pixel located in an N-th row of the plurality of pixel rows in the display panel 100, during the second duration DU2, the data write gate signal GW[N] may have an active level. For example, the active level of the data write gate signal GW[N] may be a low level. When the data write gate signal GW[N] has the active level, the second pixel switching element T2 and the third pixel switching element T3 of the pixel of the N-th row are turned on. In addition, the first pixel switching element T1 of the pixel of the N-th row is turned on in response to the initialization voltage VI.

A voltage which is subtraction of an absolute value |VTH| of the threshold voltage of the first pixel switching element T1 from the data voltage VDATA may be charged at the first node N1 of the pixel of the N-th row along a path generated by the first to third pixel switching elements T1, T2, and T3.

During the fourth duration DU4 and the fifth duration DU5, the emission signal EM[N] corresponding to the N-th row of the plurality of pixel rows in the display panel 100 may have an active level. The active level of the emission signal EM[N] may be a low level. When the emission signal EM[N] has the active level, the fifth pixel switching element T5 and the sixth pixel switching element T6 of the pixel of the N-th row are turned on. In addition, the first pixel switching element T1 of the pixel of the N-th row is turned on by the data voltage VDATA.

A driving current flows through the fifth pixel switching element T5, the first pixel switching element T1, and the sixth pixel switching element T6 to drive the organic light emitting diode OLED. An intensity of the driving current may be determined by the level of the data voltage VDATA. A luminance of the organic light emitting diode OLED is determined by the intensity of the driving current. The driving current ISD (not shown) flowing through a path from the input electrode to the output electrode of the first pixel switching element T1 is determined as following Equation 1.

$$ISD = \frac{1}{2}\mu Cox\frac{W}{L}(VSG - |VTH|)^2 \quad \text{[Equation 1]}$$

In Equation 1, μ is a mobility of the first pixel switching element T1. Cox is a capacitance per unit area of the first pixel switching element T1. W/L is a width to length ratio of the first pixel switching element T1. VSG is a voltage between the input electrode N2 of the first pixel switching element T1 and the control node N1 of the first pixel switching element T1. |VTH| is the threshold voltage of the first pixel switching element T1.

The voltage VG of the first node N1 after the compensation of the threshold voltage |VTH| during the second duration DU2 may be represented as following Equation 2.

$$VG = VDATA - |VTH| \quad \text{[Equation 2]}$$

When the organic light emitting diode OLED emits the light during the fourth duration DU4, the driving voltage VOV and the driving current ISD may be represented as following Equations 3 and 4. In Equation 3, VS is a voltage of the second node N2.

$$VOV = VS - VG - |VTH| = ELVDD - (VDATA - |VTH|) - |VTH| = ELVDD - VDATA \quad \text{[Equation 2]}$$

$$ISD = \frac{1}{2}\mu Cox\frac{W}{L}(ELVDD - VDATA)^2 \quad \text{[Equation 4]}$$

The threshold voltage |VTH| is compensated during the second duration DU2, so that the driving current ISD may be determined regardless of the threshold voltage |VTH| of the first pixel switching element T1 when the organic light emitting diode OLED emits the light during the fourth duration DU4.

Figure 4:
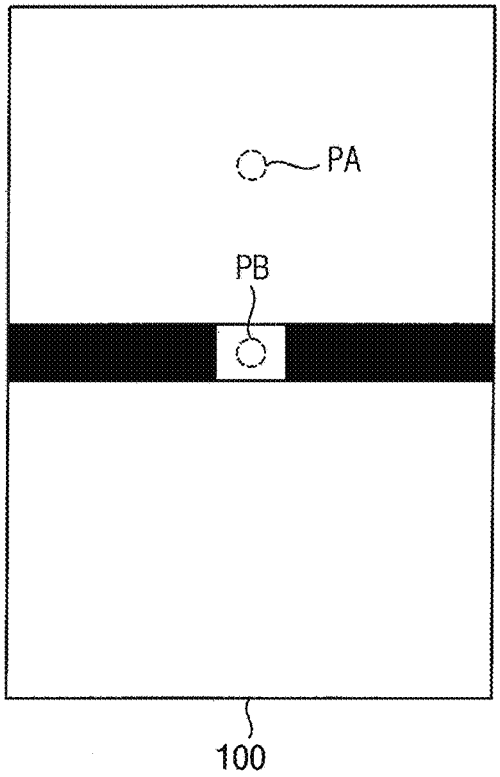
FIG. 4 is a conceptual diagram illustrating the display panel of FIG. 1 displaying a first image, according to some example embodiments of the present disclosure.
Figure 5:
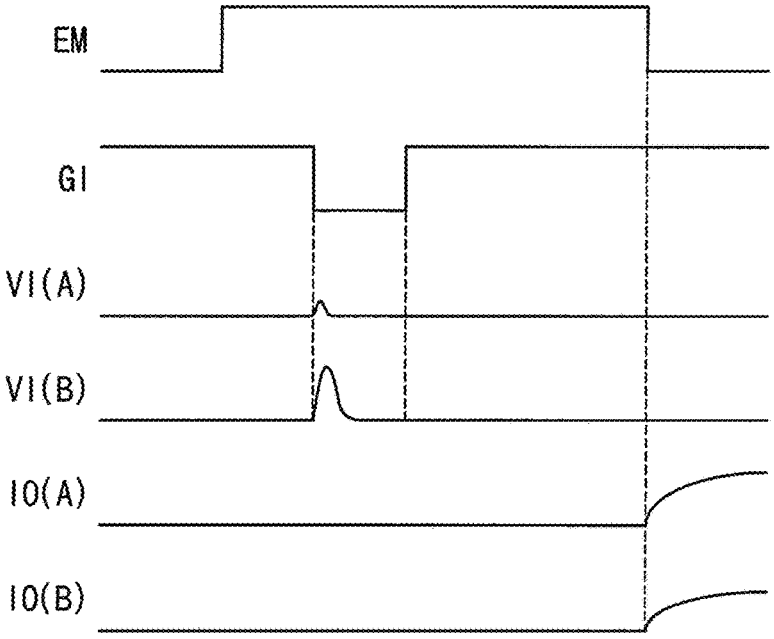
FIG. 5 is a timing diagram illustrating initialization voltages and output currents corresponding to A area and B area when the display panel of FIG. 1 displaying the first image, according to some example embodiments of the present disclosure.

FIG. 4 is a conceptual diagram illustrating the display panel 100 of FIG. 1 displaying a first image, according to some example embodiments of the present disclosure. FIG. 5 is a timing diagram illustrating initialization voltages VI and output currents IO corresponding to A area and B area when the display panel 100 of FIG. 1 displaying the first image, according to some example embodiments of the present disclosure.

Referring to FIGS. 1-5, in some example embodiments, when the data write gate signal GW[N] of a first pixel (e.g. a pixel in the N-th row) among the plurality pixels in the display panel 100 is activated, the data initialization gate signal GI[N+1] of a second pixel (e.g. a pixel in the (N+1)-th row) among the pixels may be activated. The data writing operation GW[N] of the first pixel and the initialization operation GI[N+1] of the storage capacitor CST of the second pixel may be concurrently or simultaneously operated so that a level of the initialization voltage VI in the initialization operation GI[N+1] of the storage capacitor CST may be changed due to the data voltage VDATA in the data writing operation GW[N].

The A area and the B area of FIG. 5 respectively represent a white image. Left and right areas of the A area represent a white image. In contrast, left and right areas of the B area represent a black image.

In some example embodiments, a data voltage corresponding to a white image may be greater than a data voltage corresponding to a black image. Thus, when a horizontal row corresponding to the A area PA is scanned and the data are written in the horizontal row corresponding to the A area PA, the level of the initialization voltage VI(A) may be changed in a relatively little amount due to the white image of the left and right areas of the A area PA. When a horizontal row corresponding to the B area PB is scanned and the data are written in the horizontal row corresponding to the B area PB, the level of the initialization voltage VI(B) may be changed in a relatively great amount due to the black image of the left and right areas of the B area PB.

When the data are written in the horizontal row corresponding to the B area PB, the level of the initialization voltage VI(B) may be changed in a relatively great amount and the high power voltage ELVDD may be increased in a relatively great amount due to a coupling capacitance so that a sufficient output current IO(B) may not flow through the B area PB.

In contrast, when the data are written in the horizontal row corresponding to the A area PA, the level of the initialization voltage VI(A) may be changed in a relatively little amount and the high power voltage ELVDD may be increased in a relatively little amount due to a coupling capacitance so that a sufficient output current IO(B) may flow through the A area PA.

Thus, although the A area PA and the B area PB have the same target luminance, a luminance of the B area PB may be less than a luminance of the A area PA.

Figure 6:
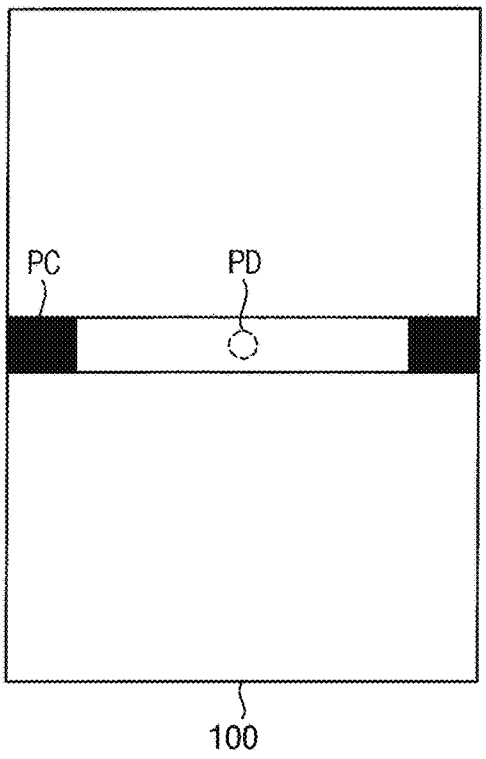
FIG. 6 is a conceptual diagram illustrating the display panel of FIG. 1 displaying a second image, according to some example embodiments of the present disclosure.
Figure 7:
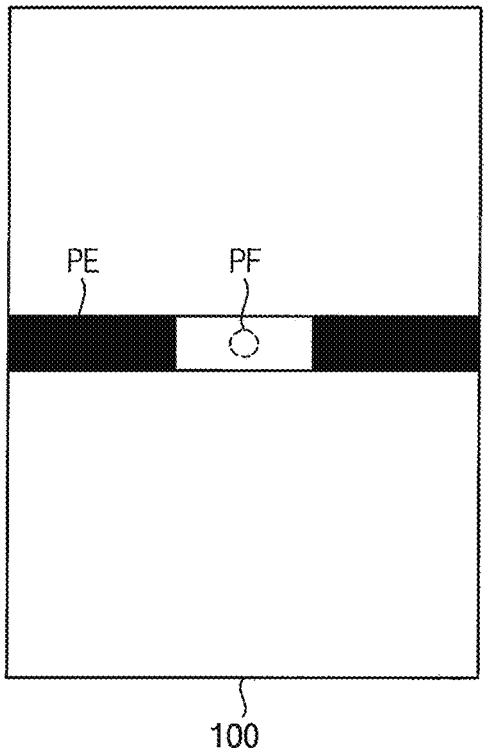
FIG. 7 is a conceptual diagram illustrating the display panel of FIG. 1 displaying a third image, according to some example embodiments of the present disclosure.
Figure 8:
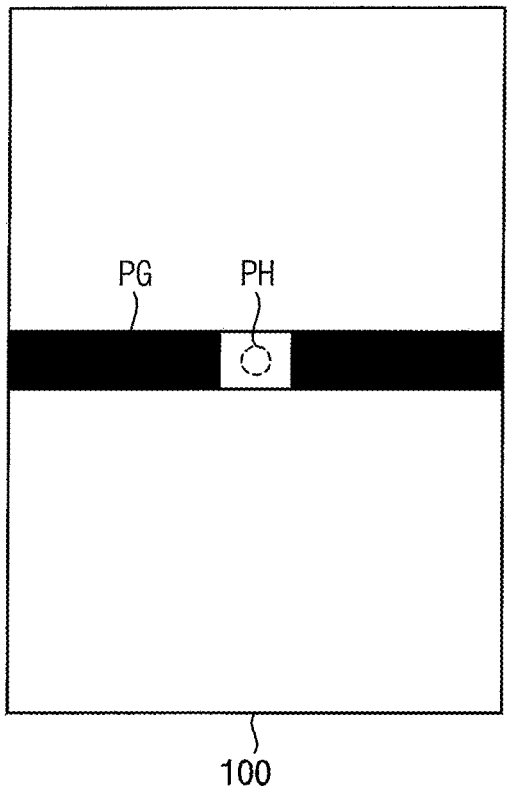
FIG. 8 is a conceptual diagram illustrating the display panel of FIG. 1 displaying a fourth image, according to some example embodiments of the present disclosure.
Figure 9:
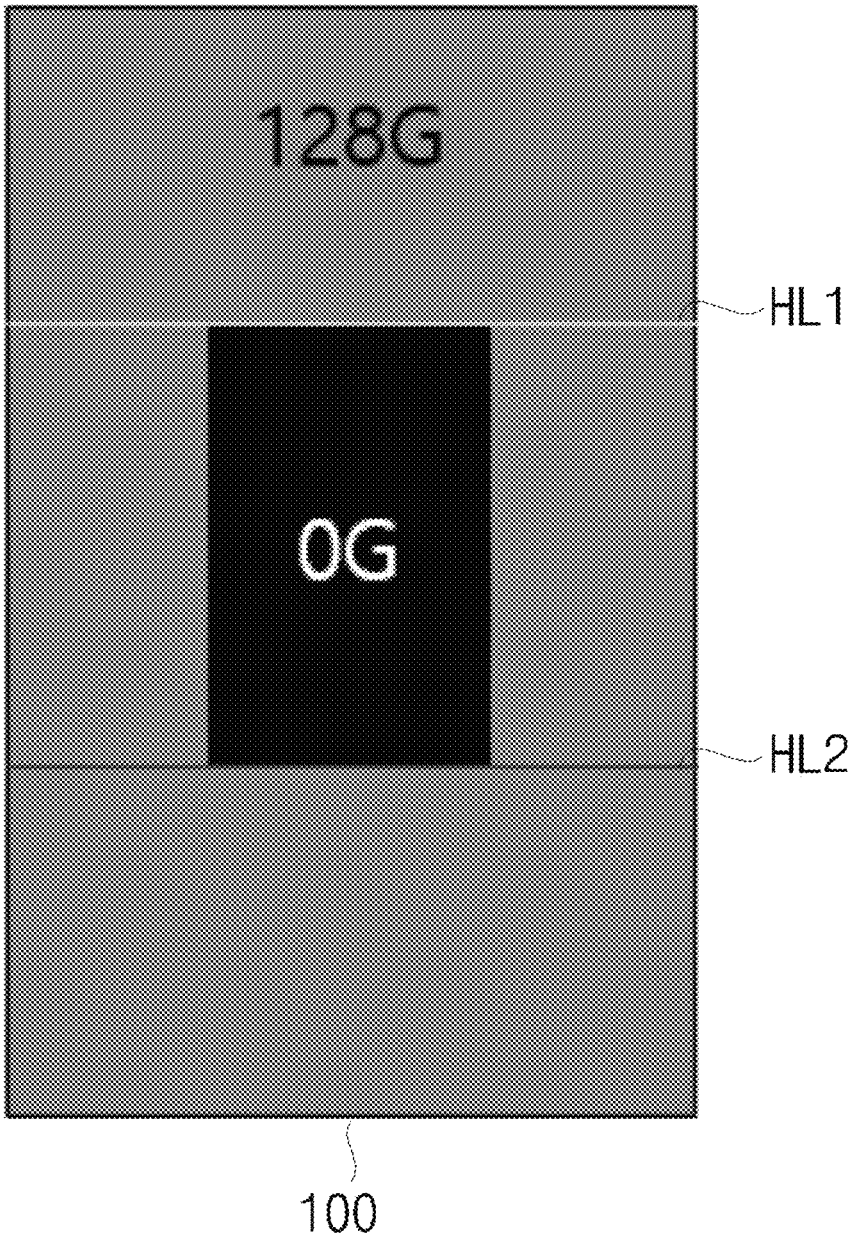
FIG. 9 is a conceptual diagram illustrating the display panel of FIG. 1 displaying a fifth image, according to some example embodiments of the present disclosure.
Figure 10:
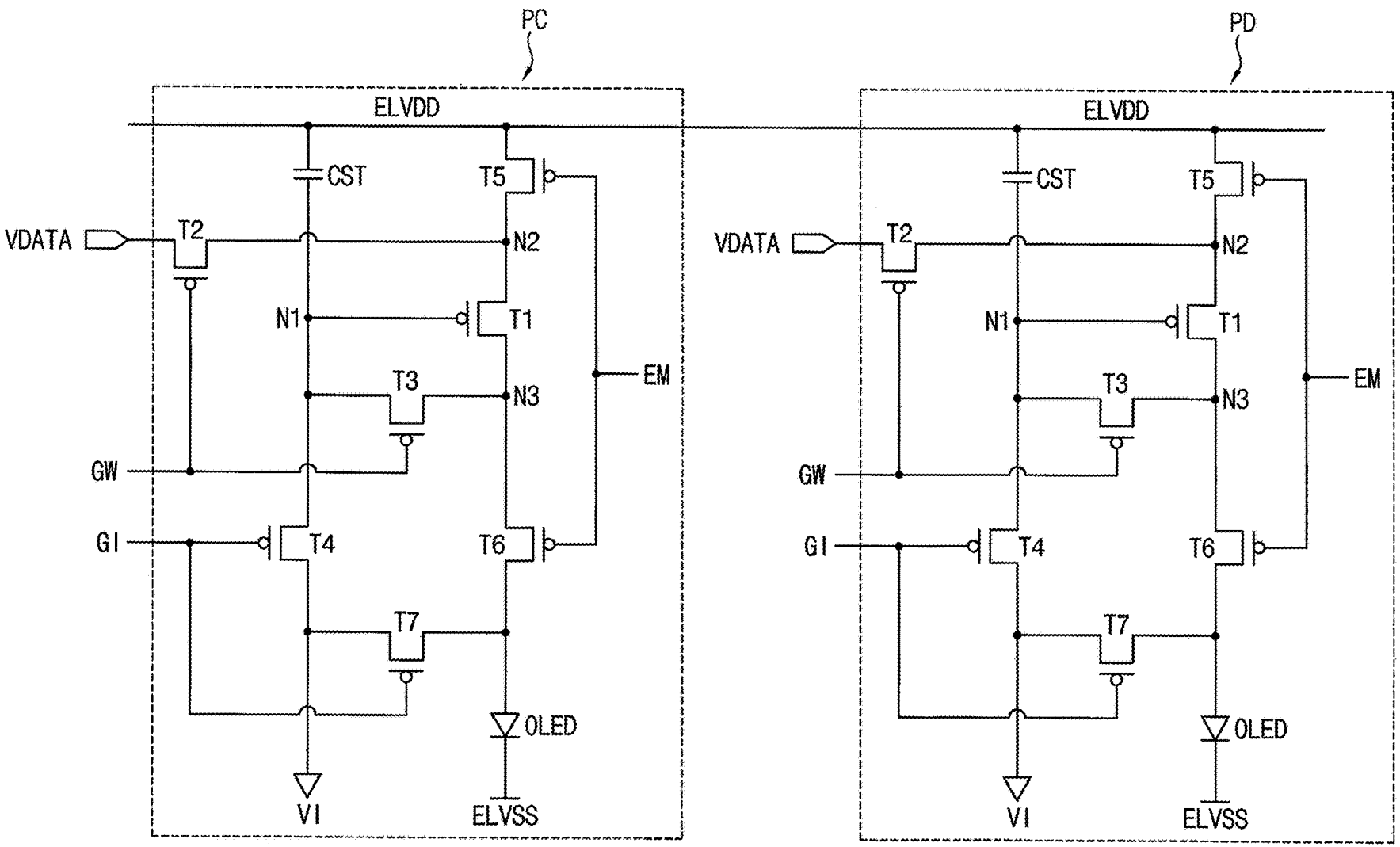
FIG. 10 is a circuit diagram illustrating a pixel in C area of FIG. 6 and a pixel in D area of FIG. 6, according to some example embodiments of the present disclosure.

FIG. 6 is a conceptual diagram illustrating the display panel 100 of FIG. 1 displaying a second image, according to some example embodiments of the present disclosure. FIG. 7 is a conceptual diagram illustrating the display panel 100 of FIG. 1 displaying a third image, according to some example embodiments of the present disclosure. FIG. 8 is a conceptual diagram illustrating the display panel 100 of FIG. 1 displaying a fourth image, according to some example embodiments of the present disclosure. FIG. 9 is a conceptual diagram illustrating the display panel 100 of FIG. 1 displaying a fifth image, according to some example embodiments of the present disclosure. FIG. 10 is a circuit diagram illustrating a pixel in C area of FIG. 6 and a pixel in D area of FIG. 6, according to some example embodiments of the present disclosure.

Referring to FIGS. 1-10, a black area PC adjacent to a white area PD is relatively small in FIG. 6, a black area PE adjacent to a white area PF in FIG. 7 is greater than the black area PC adjacent to the white area PD in FIG. 6 and a black area PG adjacent to a white area PH in FIG. 8 is greater than the black area PE adjacent to the white area PF in FIG. 7.

As shown in FIG. 10, electrodes applying the high power voltage ELVDD of the pixels (e.g. a pixel in the C area and a pixel in the D area) of the display panel 100 are connected to each other. Thus, when the level of the initialization voltage VI of the C area PC is changed, the level of the high power voltage ELVDD may be changed due to a coupling capacitance in the pixel in the C area PC of the display panel 100. When the level of the high power voltage ELVDD is changed, the luminance of the pixel in the D area PD may be changed.

Similarly to above explanation, when the data are written in the horizontal row corresponding to the D area PD, the level of the initialization voltage VI may be changed by the C area PC displaying the black image. The change of the level of the initialization voltage VI may affect the level of the high power voltage ELVDD by the coupling capacitance. Accordingly, the luminance of the D area PD may be reduced.

When the data are written in the horizontal row corresponding to the F area PF, the level of the initialization voltage VI may be changed by the E area PE displaying the black image. The change of the level of the initialization voltage VI may affect the level of the high power voltage ELVDD by the coupling capacitance. Accordingly, the luminance of the F area PF may be reduced. The area PE displaying the black image in FIG. 7 is larger than the area PC displaying the black image in FIG. 6 so that the luminance of the F area PF in FIG. 7 may be less than the luminance of the D area PD in FIG. 6.

When the data are written in the horizontal row corresponding to the H area PH, the level of the initialization voltage VI may be changed by the G area PG displaying the black image. The change of the level of the initialization voltage VI may affect the level of the high power voltage ELVDD by the coupling capacitance. Accordingly, the luminance of the H area PH may be reduced. The area PG displaying the black image in FIG. 8 is larger than the area PE displaying the black image in FIG. 7 so that the luminance of the H area PH in FIG. 8 may be less than the luminance of the F area PF in FIG. 7.

As shown in FIG. 9, if the display panel 100 starts to display with a 128 gray scale an image including a rectangle having 0 gray level (0G) after the display panel 100 displays an image having 128 gray level (128G) in an entire horizontal line, a transition of the data voltage may be occurred. Due to the transition of the data voltage, the level of the initialization voltage VI may be changed. The change of the level of the initialization voltage VI may affect the level of the high power voltage ELVDD by the coupling capacitance. Accordingly, the luminance of a first horizontal line HL1 may be increased.

If the display panel 100 starts to display an image having the 128 gray level (128G) in an entire horizontal line after the display panel 100 displays the image including the rectangle having 0 gray level (0G), a transition of the data voltage may be occurred. Due to the transition of the data voltage, the level of the initialization voltage VI may be changed. The change of the level of the initialization voltage VI may affect the level of the high power voltage ELVDD by the coupling capacitance. Accordingly, the luminance of a second horizontal line HL2 may be decreased.

Herein, a direction of the transition of the data voltage in the first horizontal line HL1 may be opposite to a direction of the transition of the data voltage in the second horizontal line HL2 so that one of the first horizontal line HL1 and the second horizontal line HL2 may be brighter and the other may be darker.

Although the first horizontal line HL1 is illustrated as a brighter line and the second horizontal line HL2 is illustrated as a darker line in FIG. 9, the present disclosure may not be limited thereto. Alternatively, in some embodiments, according to a panel structure, a driving mode, and a data voltage, the first horizontal line HL1 may be a darker line and the second horizontal line HL2 may be a brighter line.

Figure 11:
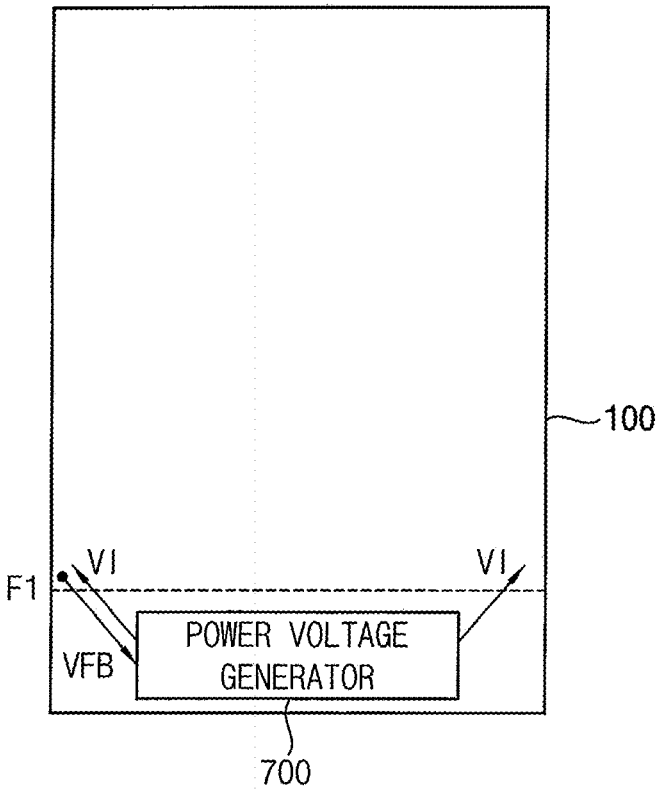
FIG. 11 is a conceptual diagram illustrating the display panel of FIG. 1 and a power voltage generator of FIG. 1, according to some example embodiments of the present disclosure.
Figure 12:
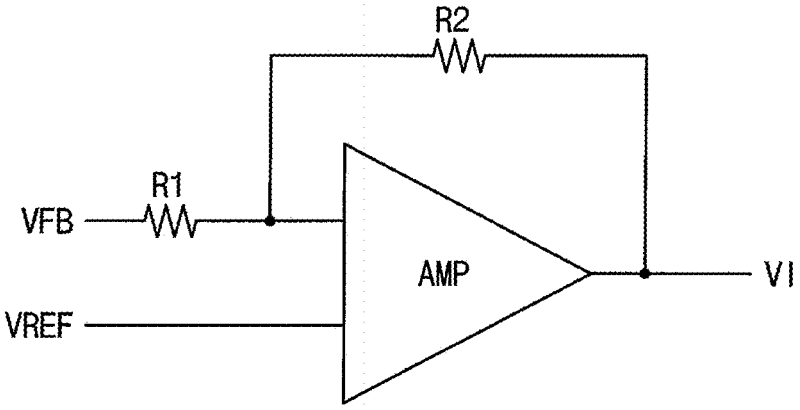
FIG. 12 is a circuit diagram illustrating the power voltage generator of FIG. 1, according to some example embodiments of the present disclosure.
Figure 13:
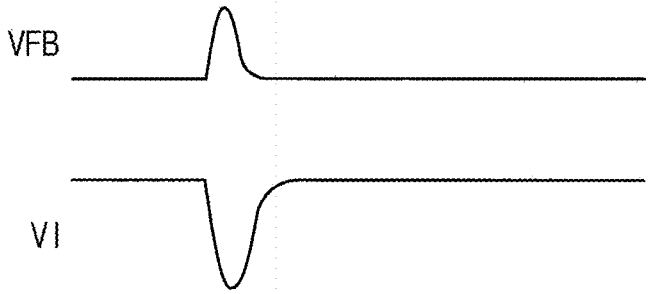
FIG. 13 is a timing diagram illustrating an input voltage and an output voltage of the power voltage generator of FIG. 12, according to some example embodiments of the present disclosure.

FIG. 11 is a conceptual diagram illustrating the display panel 100 of FIG. 1 and the power voltage generator 700 of FIG. 1, according to some example embodiments of the present disclosure. FIG. 12 is a circuit diagram illustrating the power voltage generator 700 of FIG. 1, according to some example embodiments of the present disclosure. FIG. 13 is a timing diagram illustrating an input voltage and an output voltage of the power voltage generator 700 of FIG. 12, according to some example embodiments of the present disclosure.

Referring to FIGS. 1-13, the power voltage generator 700 may receive a feedback initialization voltage VFB from the display panel 100. The power voltage generator 700 may compensate the initialization voltage VI based on the feedback initialization voltage VFB. The power voltage generator 700 may output the compensated initialization voltage VI to the display panel 100. The power voltage generator 700 may output the compensated initialization voltage VI to both side portions of the display panel 100. For example, the power voltage generator 700 may receive the feedback initialization voltage VFB from a first feedback area F1 of the display panel 100. The first feedback area F1 may be a position of an initialization voltage line on the display panel 100. For example, the first feedback area F1 may be a first side lower portion of the display panel 100.

For example, the power voltage generator 700 may be mounted on the display panel 100. For example, the power voltage generator 700 may be integrally formed with the driving controller 200 and the data driver 500.

The power voltage generator 700 may include an amplifier AMP (including a first input terminal, a second input terminal, and an output terminal), an input resistor R1, and an output resistor (or a feedback resistor) R2.

The feedback initialization voltage VFB may be applied to a first end portion of the input resistor R1. A second end portion of the input resistor R1 may be connected to the first input terminal. The output resistor R2 may be connected between the first input terminal and the output terminal of the amplifier AMP.

A reference voltage VREF may be applied to the second input terminal of the amplifier AMP. The initialization voltage VI may be output from the output terminal of the amplifier AMP.

A gain of the amplifier AMP may be determined by a resistance of the input resistor R1 and a resistance of the output resistor R2. The gain may represent a ratio of the initialization voltage VI and the feedback initialization voltage VFB (e.g., gain=VI/VFB). Herein, an absolute value of the gain may be equal to or greater than one (e.g., $|(VI/VFB)|\geq 1$).

The power voltage generator 700 may output the initialization voltage VI having a decreasing waveform corresponding to an increasing waveform of the feedback initialization voltage VFB. An absolute value of an amplitude of the decreasing waveform of the initialization voltage VI may be equal to or greater than an absolute value of an amplitude of the increasing waveform of the feedback initialization voltage VFB (e.g., $|(VI)|\geq|(VFB)|$).

According to some example embodiments, the display apparatus including the power voltage generator 700 receives the feedback initialization voltage VFB of the pixel and compensates the initialization voltage VI. Thus, a distortion of the initialization voltage VI may be reduced or prevented so that an output current of the pixel may not be changed due to the distortion of the initialization voltage VI. For example, the initialization voltage VI is compensated so that the white area PD in FIG. 6, the white area PF in FIG. 7, and the white area PH in FIG. 8 may have substantially the same luminance. For example, the initialization voltage VI is compensated so that the first horizontal line HL1 and the second horizontal line HL2 in FIG. 9 may have substantially the same luminance. Thus, the display defect due to the change of the output current of the pixel may be reduced or prevented so that the display quality of the display panel 100 may be enhanced.

Figure 14:
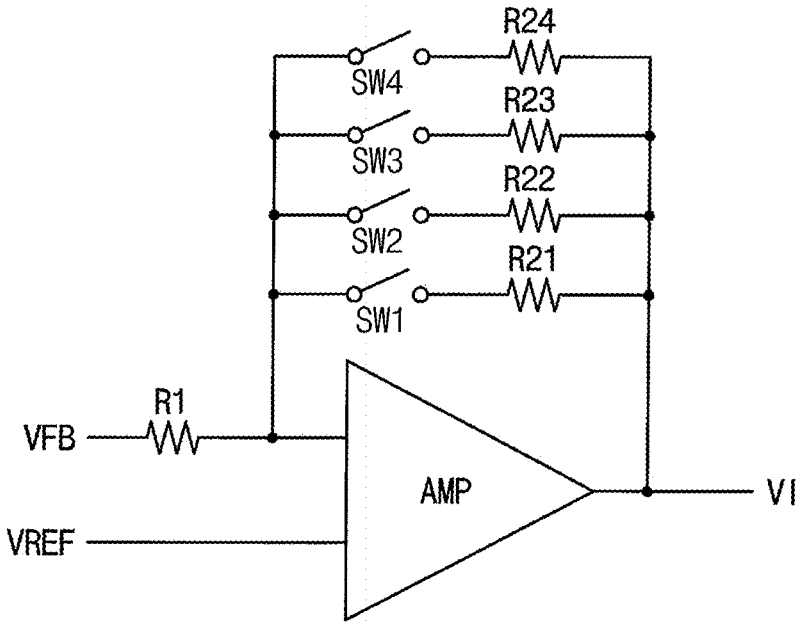
FIG. 14 is a circuit diagram illustrating a power voltage generator of a display apparatus, according to some example embodiments of the present disclosure.
Figure 15:
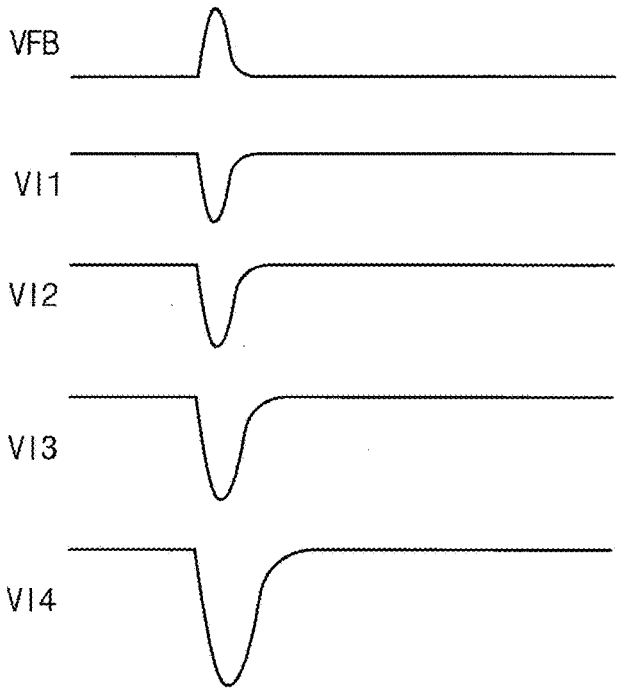
FIG. 15 is a timing diagram illustrating an input voltage and an output voltage of the power voltage generator of FIG. 14, according to some example embodiments of the present disclosure.

FIG. 14 is a circuit diagram illustrating a power voltage generator 700 of a display apparatus, according to some example embodiments of the present disclosure. FIG. 15 is a timing diagram illustrating an input voltage and an output voltage of the power voltage generator 700 of FIG. 14, according to some example embodiments of the present disclosure.

The display apparatus and the method of driving the display apparatus according to some example embodiments are substantially the same as the display apparatus and the method of driving the display apparatus of the previous example embodiments discussed with respect to FIGS. 1-13 except for the structure of the power voltage generator 700. Thus, the same reference numerals will be used to refer to the same or like parts as those described in the previous example embodiment of FIGS. 1-13 and any repetitive explanation concerning the above elements may not be provided again.

Referring to FIGS. 1-3, 11, 14, and 15, the display apparatus includes a display panel 100 and a display panel driver. The display panel driver includes a driving controller 200, a gate driver 300, a gamma reference voltage generator 400, a data driver 500, and an emission driver 600. The display panel driver further includes a power voltage generator 700.

The power voltage generator 700 may receive a feedback initialization voltage VFB from the display panel 100. The power voltage generator 700 may compensate the initialization voltage VI based on the feedback initialization voltage VFB. The power voltage generator 700 may output the compensated initialization voltage VI to the display panel 100. The power voltage generator 700 may output the compensated initialization voltage VI to both side portions of the display panel 100. For example, the power voltage generator 700 may receive the feedback initialization voltage VFB from a first feedback area F1 of the display panel 100. The first feedback area F1 may refer to a position of an initialization voltage line on the display panel 100. For example, the first feedback area F1 may be a first side lower portion of the display panel 100.

In some example embodiments, the power voltage generator 700 may adjust a gain of an amplifier AMP representing a ratio of the initialization voltage VI and the feedback initialization voltage VFB (e.g., gain=VI/VFB).

The power voltage generator 700 may include the amplifier AMP (including a first input terminal, a second input terminal, and an output terminal), an input resistor R1, a plurality of switches SW1, SW2, SW3, and SW4, and a plurality of output resistors R21, R22, R23, and R24.

The feedback initialization voltage VFB may be applied to a first end portion of the input resistor R1. A second end portion of the input resistor R1 may be connected to the first input terminal of the amplifier AMP.

The switched SW1, SW2, SW3, and SW4 may be connected to the first input terminal. The output resistors R21, R22, R23, and R24 may be respectively connected between the switches SW1, SW2, SW3, and SW4 and the output terminal.

A reference voltage VREF may be applied to the second input terminal. The initialization voltage VI may be output from the output terminal.

The gain of the amplifier AMP may be determined by a resistance of the input resistor R1 and the resistances of the output resistors R21, R22, R23, and R24. The gain may represent the ratio of the initialization voltage VI and the feedback initialization voltage VFB (e.g., gain=VI/VFB). Herein, an absolute value of the gain may be equal to or greater than one (e.g., |(VI/VFB)|≥1).

When a first switch SW1 is turned on and second to fourth switches SW2, SW3, and SW4 are turned off, the gain may be determined by a ratio between the resistance of the input resistor R1 and a resistance of a first output resistor R21 (e.g., gain=R1/R21), and the power voltage generator 700 may output a first initialization voltage VI1.

When the second switch SW2 is turned on and the first, third, and fourth switches SW1, SW3, and SW4 are turned off, the gain may be determined by a ratio between the resistance of the input resistor R1 and a resistance of the second output resistor R22 (e.g., gain=R1/R22), and the power voltage generator 700 may output a second initialization voltage VI2. An absolute value of an amplitude of a decreasing waveform of the second initialization voltage VI2 may be greater than an absolute value of an amplitude of a decreasing waveform of the first initialization voltage VI1 (e.g., |(VI2)|>|(VI1)|).

When the third switch SW3 is turned on and the first, second, and fourth switches SW1, SW2, and SW4 are turned off, the gain may be determined by a ratio between the resistance of the input resistor R1 and a resistance of the third output resistor R23 (e.g., gain=R1/R23), and the power voltage generator 700 may output a third initialization voltage VI3. An absolute value of an amplitude of a decreasing waveform of the third initialization voltage VI3 may be greater than the absolute value of the amplitude of the decreasing waveform of the second initialization voltage VI2 (e.g., |(VI3)|>|(VI2)|).

When the fourth switch SW4 is turned on and the first to third switches SW1, SW2, and SW3 are turned off, the gain may be determined by a ratio between the resistance of the input resistor R1 and a resistance of the fourth output resistor R24 (e.g., gain=R1/R24), and the power voltage generator 700 may output a fourth initialization voltage VI4. An absolute value of an amplitude of a decreasing waveform of the fourth initialization voltage VI4 may be greater than the absolute value of the amplitude of the decreasing waveform of the third initialization voltage VI3 (e.g., |(VI4)|>|(VI3)|).

The present disclosure is not limited to the number of the switches SW1, SW2, SW3, and SW4 and the number of the output resistors R21, R22, R23, and R24 corresponding to the switches SW1, SW2, SW3, and SW4.

According to some example embodiments, the display apparatus includes the power voltage generator 700 for receiving the feedback initialization voltage VFB of the pixel and for compensating the initialization voltage VI. Thus, a distortion of the initialization voltage VI may be reduced or prevented so that an output current of the pixel may not be changed due to the distortion of the initialization voltage VI. Thus, the display defect due to the change of the output current of the pixel may be reduced or prevented so that the display quality of the display panel 100 may be enhanced.

Figure 16:
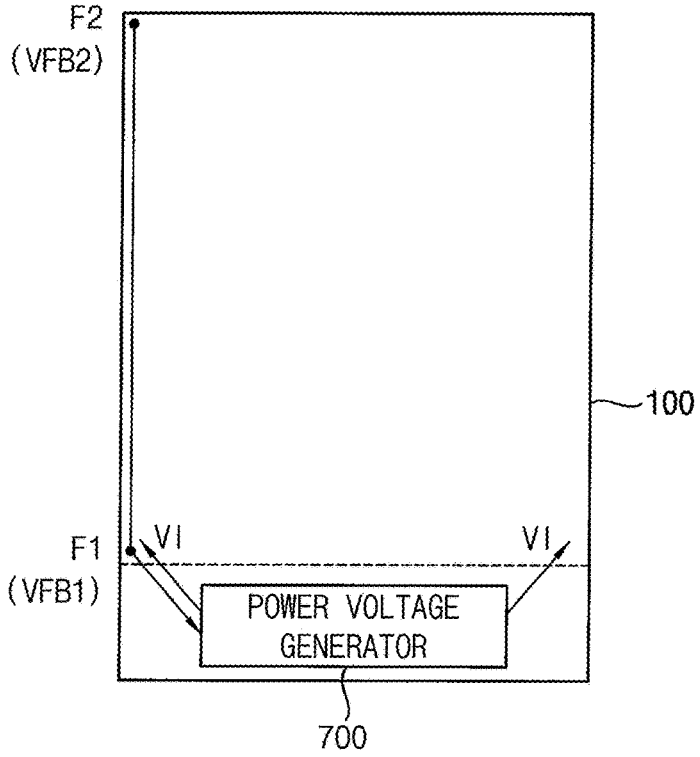
FIG. 16 is a conceptual diagram illustrating a display panel and a power voltage generator of a display apparatus, according to some example embodiments of the present disclosure.
Figure 17:
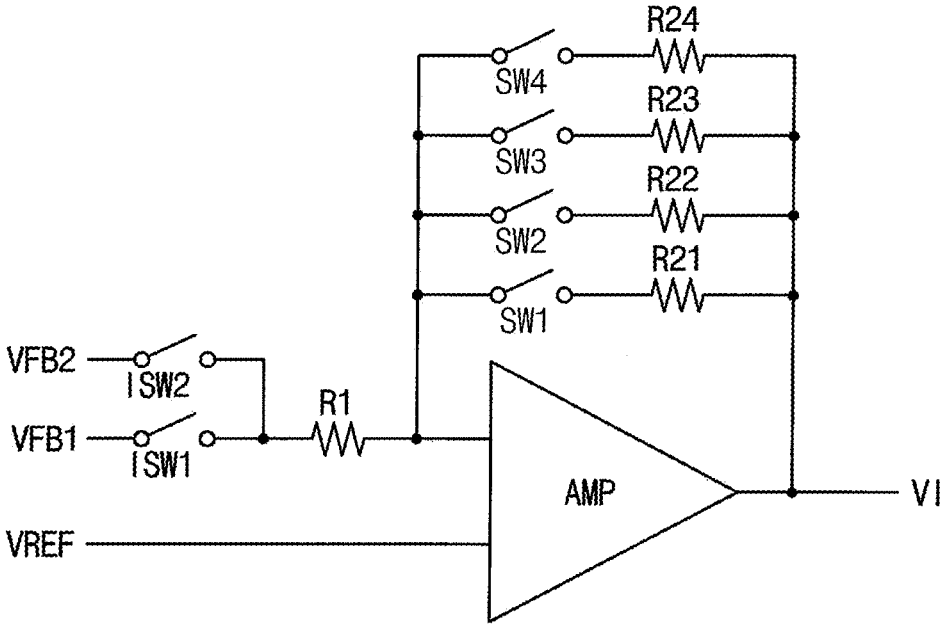
FIG. 17 is a circuit diagram illustrating the power voltage generator of FIG. 16, according to some example embodiments of the present disclosure.

FIG. 16 is a conceptual diagram illustrating a display panel 100 and a power voltage generator 700 of a display apparatus, according to some example embodiments of the present disclosure. FIG. 17 is a circuit diagram illustrating the power voltage generator 700 of FIG. 16, according to some example embodiments of the present disclosure.

The display apparatus and the method of driving the display apparatus according to some example embodiments are substantially the same as the display apparatus and the method of driving the display apparatus of the previous example embodiments discussed with respect to FIGS. 1-13 except for the structure of the power voltage generator 700 and the feedback area. Thus, the same reference numerals will be used to refer to the same or like parts as those described in the previous example embodiments of FIGS. 1-13 and any repetitive explanation concerning the above elements may not be provided again.

Referring to FIGS. 1-3, 16, and 17, the display apparatus includes a display panel 100 and a display panel driver. The display panel driver includes a driving controller 200, a gate driver 300, a gamma reference voltage generator 400, a data driver 500, and an emission driver 600. The display panel driver further includes a power voltage generator 700.

The power voltage generator 700 may receive a feedback initialization voltage VFB from the display panel 100. The power voltage generator 700 may compensate the initialization voltage VI based on the feedback initialization voltage VFB. The power voltage generator 700 may output the compensated initialization voltage VI to the display panel 100. The power voltage generator 700 may output the compensated initialization voltage VI to both side portions of the display panel 100. For example, the power voltage generator 700 may receive a first feedback initialization voltage VFB1 from a first feedback area F1 of the display panel 100 and a second feedback initialization voltage VFB2 from a second feedback area F2 of the display panel 100. The first feedback area F1 and the second feedback area F2 may represent positions of an initialization voltage line on the display panel 100. For example, the first feedback area F1 may be a first side lower portion of the display panel 100. For example, the second feedback area F2 may be a first side upper portion of the display panel 100.

When the power voltage generator 700 receives the plurality of feedback initialization voltages VFB1 and VFB2, an accuracy of the compensation of the initialization voltage VI may be enhanced.

For example, the power voltage generator 700 may receive one of the plurality of feedback initialization voltages VFB1 and VFB2 received from the plurality of feedback areas F1 and F2 to compensate the initialization voltage VI.

The power voltage generator 700 may include the amplifier AMP (including a first input terminal, a second input terminal, and an output terminal), a first input switch ISW1, a second input switch ISW2, an input resistor R1, a plurality of switches SW1, SW2, SW3, and SW4, and a plurality of output resistors R21, R22, R23, and R24.

The first feedback initialization voltage VFB1 may be applied to the first input switch ISW1. The second feedback initialization voltage VFB2 may be applied to the second input switch ISW2. The input resistor R1 may include a first end portion connected to the first input switch ISW1 and the second input switch ISW2 and a second end portion connected to the first input terminal.

The switched SW1, SW2, SW3, and SW4 may be connected to the first input terminal. The output resistors R21, R22, R23, and R24 may be respectively connected between the switches SW1, SW2, SW3, and SW4 and the output terminal.

A reference voltage VREF may be applied to the second input terminal. The initialization voltage VI may be output from the output terminal.

The gain of the amplifier AMP may be determined by a resistance of the input resistor R1 and resistances of the output resistors R21, R22, R23, and R24. The gain may represent the ratio of the initialization voltage VI and the feedback initialization voltage VFB (e.g., gain=VI/VFB).

Herein, an absolute value of the gain may be equal to or greater than one (e.g., |(VI/VFB)|≥1).

When a first switch SW1 is turned on and second to fourth switches SW2, SW3, and SW4 are turned off, the gain may be determined by a ratio between the resistance of the input resistor R1 and a resistance of a first output resistor R21 (e.g., (e.g., gain=R1/R21), and the power voltage generator 700 may output a first initialization voltage VI1.

When the second switch SW2 is turned on and the first, third, and fourth switches SW1, SW3, and SW4 are turned off, the gain may be determined by a ratio between the resistance of the input resistor R1 and a resistance of the second output resistor R22 (e.g., gain=R1/R22), and the power voltage generator 700 may output a second initialization voltage VI2. An absolute value of an amplitude of a decreasing waveform of the second initialization voltage VI2 may be greater than an absolute value of an amplitude of a decreasing waveform of the first initialization voltage VI1 (e.g., |(VI2)|>|(VI1)|).

When the third switch SW3 is turned on and the first, second, and fourth switches SW1, SW2, and SW4 are turned off, the gain may be determined by a ratio between the resistance of the input resistor R1 and a resistance of the third output resistor R23 (e.g., gain=R1/R23), and the power voltage generator 700 may output a third initialization voltage VI3. An absolute value of an amplitude of a decreasing waveform of the third initialization voltage VI3 may be greater than the absolute value of the amplitude of the decreasing waveform of the second initialization voltage VI2 (e.g., |(VI3)|>|(VI2)|).

When the fourth switch SW4 is turned on and the first to third switches SW1, SW2, and SW3 are turned off, the gain may be determined by a ratio between the resistance of the input resistor R1 and a resistance of the fourth output resistor R24 (e.g., gain=R1/R24), and the power voltage generator 700 may output a fourth initialization voltage VI4. An absolute value of an amplitude of a decreasing waveform of the fourth initialization voltage VI4 may be greater than the absolute value of the amplitude of the decreasing waveform of the third initialization voltage VI3 (e.g., |(VI4)|>|(VI3)|).

When a second distance from the second feedback area F2 to the power voltage generator 700 is greater than a first distance from the first feedback area F1 to the power voltage generator 700, a second gain representing a ratio of the initialization voltage VI and the second feedback initialization voltage VFB2 (e.g., gain−VI/VFB2) may be greater than a first gain representing a ratio of the initialization voltage VI and the first feedback initialization voltage VFB1 (e.g., (VI/VFB2)>(VI/VFB1)).

A transmission distance of the second feedback initialization voltage VFB2 is relatively greater than the transmission distance of the first feedback initialization voltage VFB1, so that the second feedback initialization voltage VFB2 may be relatively smaller than the first feedback initialization voltage VFB1. Thus, when the second feedback initialization voltage VFB2 is inputted to the amplifier AMP, the initialization voltage VI may be compensated by a relatively larger gain.

A transmission distance of the first feedback initialization voltage VFB1 is relatively smaller than the transmission distance of the second feedback initialization voltage VFB2, so that the first feedback initialization voltage VFB2 may be relatively greater than the second feedback initialization voltage VFB2. Thus, when the first feedback initialization voltage VFB1 is inputted, the initialization voltage VI may be compensated by a relatively smaller gain.

The gain for compensating the initialization voltage VI may be determined by controlling the switches SW1, SW2, SW3, and SW4 according to the feedback initialization voltages VFB1 and VFB2.

According to some example embodiments, the display apparatus includes the power voltage generator 700 for receiving the feedback initialization voltage VFB of the pixel and for compensating the initialization voltage VI. Thus, a distortion of the initialization voltage VI may be reduced or prevented so that an output current of the pixel may not be changed due to the distortion of the initialization voltage VI. Thus, the display defect due to the change of the output current of the pixel may be reduced or prevented so that the display quality of the display panel 100 may be enhanced.

Figure 18:
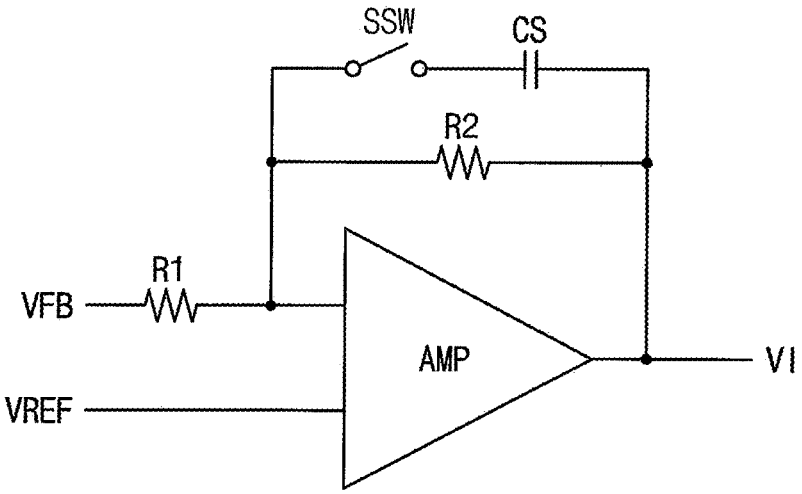
FIG. 18 is a circuit diagram illustrating a power voltage generator of a display apparatus, according to some example embodiments of the present disclosure.
Figure 19:
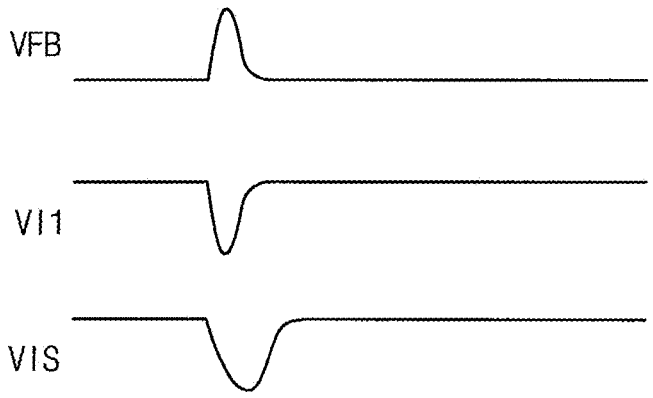
FIG. 19 is a timing diagram illustrating an input voltage and an output voltage of the power voltage generator of FIG. 18, according to some example embodiments of the present disclosure.

FIG. 18 is a circuit diagram illustrating a power voltage generator of a display apparatus, according to some example embodiments of the present disclosure. FIG. 19 is a timing diagram illustrating an input voltage and an output voltage of the power voltage generator of FIG. 18, according to some example embodiments of the present disclosure.

The display apparatus and the method of driving the display apparatus according to some example embodiments are substantially the same as the display apparatus and the method of driving the display apparatus of the previous example embodiments discussed with respect to FIGS. 1-13 except for the structure of the power voltage generator 700. Thus, the same reference numerals will be used to refer to the same or like parts as those described in the previous example embodiment of FIGS. 1-13 and any repetitive explanation concerning the above elements may not be provided again.

Referring to FIGS. 1-3, 11, 18, and 19, the display apparatus includes a display panel 100 and a display panel driver. The display panel driver includes a driving controller 200, a gate driver 300, a gamma reference voltage generator 400, a data driver 500, and an emission driver 600. The display panel driver further includes a power voltage generator 700.

The power voltage generator 700 may receive a feedback initialization voltage VFB from the display panel 100. The power voltage generator 700 may compensate the initialization voltage VI based on the feedback initialization voltage VFB. The power voltage generator 700 may output the compensated initialization voltage VI to the display panel 100. The power voltage generator 700 may output the compensated initialization voltage VI to both side portions of the display panel 100. For example, the power voltage generator 700 may receive the feedback initialization voltage VFB from a first feedback area F1 of the display panel 100. The first feedback area F1 may represent a position of an initialization voltage line on the display panel 100. For example, the first feedback area F1 may be a first side lower portion of the display panel 100.

In some example embodiments, the power voltage generator 700 may adjust a slew rate of the initialization voltage VI.

The power voltage generator 700 may include the amplifier AMP (including a first input terminal, a second input terminal, and an output terminal), an input resistor R1, an output resistor R2, a slew rate adjusting switch SSW, and a capacitor CS.

The slew rate adjusting switch SSW may be connected to the first input terminal of the amplifier AMP. The capacitor CS may include a first electrode connected to the slew rate adjusting switch SSW, and a second electrode connected to the output terminal of the amplifier AMP.

A reference voltage VREF may be applied to the second input terminal of the amplifier AMP. The initialization voltage VI may be output from the output terminal of the amplifier AMP.

When the slew rate adjusting switch SSW is turned off, the initialization voltage VI may have a relatively higher slew rate. When the slew rate adjusting switch SSW is turned on, the power voltage generator 700 may output an initialization voltage VIS having a decreased slew rate by the capacitor CS. In some example embodiments, the slew rate of the initialization voltage VI may be adjusted to enhance a display quality of the display panel 100.

According to some example embodiments, the display apparatus includes the power voltage generator 700 for receiving the feedback initialization voltage VFB of the pixel and for compensating the initialization voltage VI. Thus, a distortion of the initialization voltage VI may be reduced or prevented so that an output current of the pixel may not be changed due to the distortion of the initialization voltage VI. Thus, the display defect due to the change of the output current of the pixel may be reduced or prevented so that the display quality of the display panel 100 may be enhanced.

Figure 20:
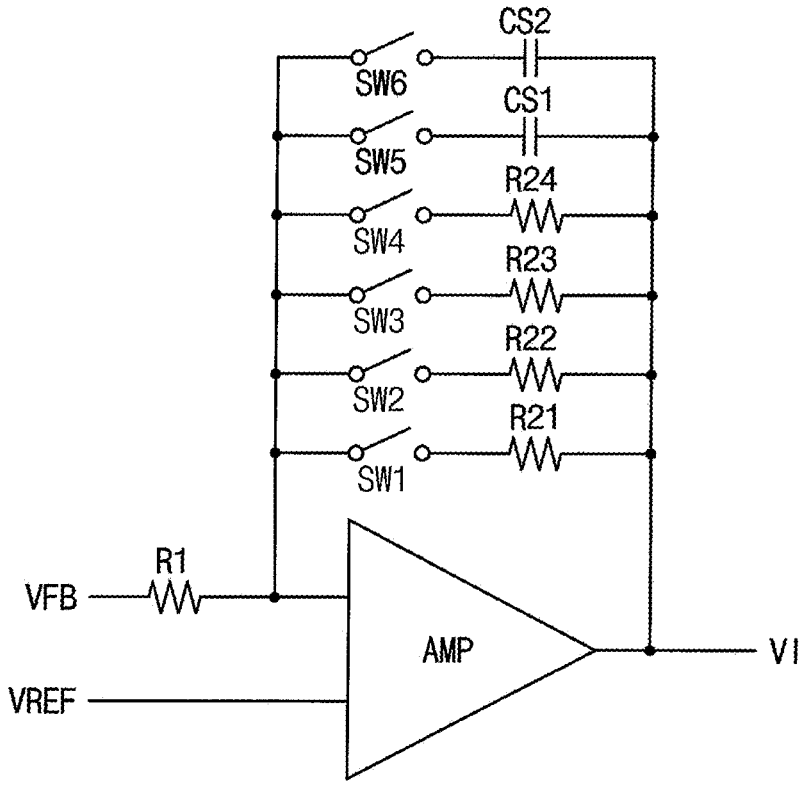
FIG. 20 is a circuit diagram illustrating a power voltage generator of a display apparatus according to some example embodiment of the present disclosure.

FIG. 20 is a circuit diagram illustrating a power voltage generator of a display apparatus, according to an example embodiment of the present disclosure.

The display apparatus and the method of driving the display apparatus according to some example embodiments are substantially the same as the display apparatus and the method of driving the display apparatus of the previous example embodiments discussed with respect to FIGS. 1-13 except for the structure of the power voltage generator 700. Thus, the same reference numerals will be used to refer to the same or like parts as those described in the previous example embodiment of FIGS. 1-13 and any repetitive explanation concerning the above elements may not be provided again.

Referring to FIGS. 1-3, 11, and 20, the display apparatus includes a display panel 100 and a display panel driver. The display panel driver includes a driving controller 200, a gate driver 300, a gamma reference voltage generator 400, a data driver 500, and an emission driver 600. The display panel driver further includes a power voltage generator 700.

The power voltage generator 700 may receive a feedback initialization voltage VFB from the display panel 100. The power voltage generator 700 may compensate the initialization voltage VI based on the feedback initialization voltage VFB. The power voltage generator 700 may output the compensated initialization voltage VI to the display panel 100. The power voltage generator 700 may output the compensated initialization voltage VI to both side portions of the display panel 100. For example, the power voltage generator 700 may receive the feedback initialization voltage VFB from a first feedback area F1 of the display panel 100. The first feedback area F1 may refer to a position of an initialization voltage line on the display panel 100. For example, the first feedback area F1 may be a first side lower portion of the display panel 100.

In some example embodiments, the power voltage generator 700 may adjust a gain of an amplifier AMP representing a ratio of the initialization voltage VI and the feedback initialization voltage VFB (e.g., gain=VI/VFB). In addition, the power voltage generator 700 may adjust a slew rate of the initialization voltage VI.

The power voltage generator 700 may include the amplifier AMP (including a first input terminal, a second input terminal and an output terminal), an input resistor R1, a plurality of switches SW1, SW2, SW3, and SW4 and a plurality of output resistors R21, R22, R23, and R24.

The switched SW1, SW2, SW3, and SW4 may be connected to the first input terminal of the amplifier AMP. The output resistors R21, R22, R23 and R24 may be respectively connected between the switches SW1, SW2, SW3, and SW4 and the output terminal of the amplifier AMP.

The power voltage generator 700 may further include a plurality of slew rate adjusting switches SW5 and SW6 and a plurality of capacitors CS1 and CS2 connected between the slew rate adjusting switches SW5 and SW6 and the output terminal of the amplifier AMP.

According to switching operations of the first to fourth switches SW1, SW2, SW3, and SW4, the gain for compensating the initialization voltage VI may be adjusted. In addition, according to the switching operations of the first and second slew rate adjusting switches SW5 and SW6, the slew rate of the initialization voltage VI may be adjusted.

The present disclosure is not limited to the number of the switches SW1, SW2, SW3, and SW4 and the number of the output resistors R21, R22, R23, and R24 corresponding to the switches SW1, SW2, SW3 and SW4. The present disclosure is not limited to the number of the slew rate adjusting switches SW5 and SW6 and the number of the capacitors CS1 and CS2 corresponding to the slew rate adjusting switches SW5 and SW6.

According to some example embodiments, the display apparatus includes the power voltage generator 700 for receiving the feedback initialization voltage VFB of the pixel and for compensating the initialization voltage VI. Thus, a distortion of the initialization voltage VI may be reduced or prevented so that an output current of the pixel may not be changed due to the distortion of the initialization voltage VI. Thus, the display defect due to the change of the output current of the pixel may be reduced or prevented so that the display quality of the display panel 100 may be enhanced.

According to some example embodiments of the present disclosure, the initialization voltage VI may be compensated so that the display quality of the display panel 100 may be enhanced.

The foregoing is illustrative of the present disclosure and is not to be construed as limiting thereof. Although a few example embodiments of the present disclosure have been described, those skilled in the art will readily appreciate that many modifications are possible in the example embodiments without materially departing from the teachings of the present disclosure. Accordingly, all such modifications are intended to be included within the scope of the present disclosure as defined in the claims. In the claims, means-plus-function clauses are intended to cover the structures described herein as performing the recited function and not only structural equivalents but also equivalent structures. Therefore, it is to be understood that the foregoing is illustrative of the present disclosure and is not to be construed as limited to the specific example embodiments disclosed, and that modifications to the disclosed example embodiments, as well as other example embodiments, are intended to be included within the scope of the appended claims. The present disclosure is defined by the following claims, with equivalents of the claims to be included therein.

What is claimed is:

1. A display apparatus comprising:

a display panel comprising a plurality of pixels and configured to display an image;

a data driver configured to apply a data voltage to the display panel; and a power voltage generator configured to provide a power voltage and an initialization voltage to the display panel, wherein the power voltage generator is configured to receive a feedback initialization voltage from the display panel and configured to compensate the initialization voltage based on the feedback initialization voltage.

2. The display apparatus of claim 1, wherein at least one of the pixels comprises an organic light emitting element, and Wherein the at least one of the pixels is configured to receive a data write gate signal, a data initialization gate signal, the data voltage, and the initialization voltage, the at least one of the pixels being configured to emit light via the organic light emitting element according to a level of the data voltage to display the image.

3. The display apparatus of claim 2, wherein when a data write gate signal of a first pixel among the pixels is activated, a data initialization gate signal of a second pixel among the pixels is activated.

4. The display apparatus of claim 2, wherein the at least one of the pixels comprises:

a first pixel switching element comprising a control electrode connected to a first node, an input electrode connected to a second node, and an output electrode connected to a third node;

a second pixel switching element comprising a control electrode to which the data write gate signal is to be applied, an input electrode to which the data voltage is to be applied, and an output electrode connected to the second node;

a third pixel switching element comprising a control electrode to which the data write gate signal is to be applied, an input electrode connected to the first node, and an output electrode connected to the third node;

a fourth pixel switching element comprising a control electrode to which the data initialization gate signal is to be applied, an input electrode to which the initialization voltage is to be applied, and an output electrode connected to the first node;

a fifth pixel switching element comprising a control electrode to which an emission signal is to be applied, an input electrode to which a high power voltage is to be applied, and an output electrode connected to the second node;

a sixth pixel switching element comprising a control electrode to which the emission signal is to be applied, an input electrode connected to the third node and an output electrode connected to an anode electrode of the organic light emitting element;

a seventh pixel switching element comprising a control electrode to which the data initialization gate signal is to be applied, an input electrode to which the initialization voltage is to be applied, and an output electrode connected to the anode electrode of the organic light emitting element;

a storage capacitor comprising a first electrode to which the high power voltage is to be applied and a second electrode connected to the first node; and the organic light emitting element comprising the anode electrode and a cathode electrode to which a low power voltage is to be applied.

5. The display apparatus of claim 1, wherein the power voltage generator comprises:

an amplifier comprising a first input terminal, a second input terminal, and an output terminal;

an input resistor comprising a first end portion configured to receive the feedback initialization voltage and a second end portion connected to the first input terminal; and an output resistor connected between the first input terminal and the output terminal, wherein the second input terminal is configured to receive a reference voltage, and wherein the output terminal is configured to output the initialization voltage.

6. The display apparatus of claim 1, wherein the power voltage generator is configured to adjust a gain representing a ratio of the initialization voltage and the feedback initialization voltage.

7. The display apparatus of claim 6, wherein the power voltage generator comprises:

an amplifier comprising a first input terminal, a second input terminal, and an output terminal;

an input resistor comprising a first end portion configured to receive the feedback initialization voltage and a second end portion connected to the first input terminal;

a plurality of switches connected to the first input terminal; and a plurality of output resistors connected between the switches and the output terminal, wherein the second input terminal is configured to receive a reference voltage, and wherein the output terminal is configured to output the initialization voltage.

8. The display apparatus of claim 1, wherein the power voltage generator is configured to receive a first feedback initialization voltage from a first position of the display panel and a second feedback initialization voltage from a second position of the display panel.

9. The display apparatus of claim 8, wherein the power voltage generator comprises:

an amplifier comprising a first input terminal, a second input terminal, and an output terminal;

a first input switch configured to receive the first feedback initialization voltage;

a second input switch configured to receive the second feedback initialization voltage;

an input resistor comprising a first end portion connected to the first input switch and the second input switch and a second end portion connected to the first input terminal;

a plurality of switches connected to the first input terminal; and a plurality of output resistors connected between the switches and the output terminal, wherein the second input terminal is configured to receive a reference voltage, and wherein the output terminal is configured to output the initialization voltage.

10. The display apparatus of claim 8, wherein when a second distance from the second position of the display panel to the power voltage generator is greater than a first distance from the first position of the display panel to the power voltage generator, a second gain representing a ratio of the initialization voltage and the second feedback initialization voltage is greater than a first gain representing a ratio of the initialization voltage and the first feedback initialization voltage.

11. The display apparatus of claim 1, wherein the power voltage generator is configured to adjust a slew rate of the initialization voltage.

12. The display apparatus of claim 11, wherein the power voltage generator comprises:

an amplifier comprising a first input terminal, a second input terminal, and an output terminal;

an input resistor comprising a first end portion configured to receive the feedback initialization voltage and a second end portion connected to the first input terminal;

an output resistor connected between the first input terminal and the output terminal;

a slew rate adjusting switch connected to the first input terminal; and a capacitor comprising a first electrode connected to the slew rate adjusting switch and a second electrode connected to the output terminal, wherein the second input terminal is configured to receive a reference voltage, and wherein the output terminal is configured to output the initialization voltage.

13. The display apparatus of claim 12, wherein the power voltage generator is configured to adjust a gain representing a ratio of the initialization voltage and the feedback initialization voltage.

14. The display apparatus of claim 13, wherein the power voltage generator further comprises:

a plurality of switches connected to the first input terminal; and a plurality of output resistors connected between the plurality of switches and the output terminal.

15. The display apparatus of claim 14, wherein:

the slew rate adjusting switch comprises a plurality of slew rate adjusting switches; and the capacitor comprises a plurality of capacitors connected between the slew rate adjusting switches and the output terminal.

16. A method of driving a display apparatus, the method comprising:

applying a gate signal to a plurality of pixels of a display panel;

applying a data voltage to the plurality of pixels of the display panel;

applying a power voltage and an initialization voltage to the plurality of pixels using a power voltage generator;

receiving a feedback initialization voltage from the display panel; and compensating the initialization voltage based on the feedback initialization voltage.

17. The method of claim 16, wherein the power voltage generator comprises:

an amplifier comprising a first input terminal, a second input terminal, and an output terminal;

an input resistor comprising a first end portion configured to receive the feedback initialization voltage and a second end portion connected to the first input terminal; and an output resistor connected between the first input terminal and the output terminal, wherein a reference voltage is applied to the second input terminal, and wherein the output terminal is configured to output the initialization voltage.

18. The method of claim 16, wherein the power voltage generator is configured to adjust a gain representing a ratio of the initialization voltage and the feedback initialization voltage.

19. The method of claim 16, wherein the power voltage generator is configured to receive a first feedback initialization voltage from a first position of the display panel and a second feedback initialization voltage from a second position of the display panel.

20. The method of claim 16, wherein the power voltage generator is configured to adjust a slew rate of the initialization voltage.

* * * * *